US007721659B2

(12) United States Patent
Fast

(10) Patent No.: US 7,721,659 B2
(45) Date of Patent: May 25, 2010

(54) UNIVERSAL SUPPORT ELEMENT FOR UNIVERSAL SHELF DIVIDER, LABEL AND SIGN HOLDER

(75) Inventor: Jacob Fast, Boca Raton, FL (US)

(73) Assignee: Fast Industries, Ltd., Fort Lauderdale, FL (US)

( * ) Notice: Subject to any disclaimer, the term of this patent is extended or adjusted under 35 U.S.C. 154(b) by 631 days.

(21) Appl. No.: 11/082,760

(22) Filed: Mar. 18, 2005

(65) Prior Publication Data

US 2005/0204965 A1 Sep. 22, 2005

Related U.S. Application Data

(60) Provisional application No. 60/554,345, filed on Mar. 19, 2004.

(51) Int. Cl.
*A47B 57/00* (2006.01)
*G09F 3/18* (2006.01)

(52) U.S. Cl. ..... 108/60; 40/661.03; 24/563

(58) Field of Classification Search ..... 108/60, 108/61; 211/184; 248/205.1, 205.3, 316.1, 248/316.7; 40/658, 661.03, 661.09, 666; 24/545, 555, 556, 561, 562, 564, 571, 67.9
See application file for complete search history.

(56) References Cited

U.S. PATENT DOCUMENTS 2,332,772 A * 10/1943 Amer ..... 24/562
3,062,217 A * 11/1962 Woodhouse, Jr. ..... 40/652
3,325,929 A * 6/1967 Mauchline ..... 40/658
3,381,883 A * 5/1968 Harris ..... 24/562
3,462,809 A * 8/1969 Froehlich, Jr. ..... 24/562
3,525,493 A 8/1970 Chrietzberg et al.
3,797,076 A * 3/1974 Watkin ..... 24/562
3,825,012 A * 7/1974 Nicoll ..... 606/120
4,557,064 A 12/1985 Thompson et al.
4,582,987 A * 4/1986 Bianco ..... 40/661.03
4,775,058 A * 10/1988 Yatsko ..... 211/184
4,866,868 A * 9/1989 Kass ..... 40/661
4,997,114 A * 3/1991 Petrou ..... 223/85
5,341,945 A * 8/1994 Gibson ..... 211/184
5,682,824 A * 11/1997 Visk ..... 108/60
5,836,097 A 11/1998 Lewis et al.
6,026,603 A * 2/2000 Kump et al. ..... 40/661.03
6,484,365 B1 * 11/2002 Thompson ..... 24/546
6,571,498 B1 * 6/2003 Cyrluk ..... 40/661.03
6,637,716 B2 * 10/2003 Wear ..... 24/563
7,093,546 B2 * 8/2006 Hardy ..... 108/60
2003/0098400 A1 5/2003 Fast et al.

* cited by examiner

*Primary Examiner*—José V Chen
(74) *Attorney, Agent, or Firm*—Jacobson Holman PLLC

(57) ABSTRACT

An improved support element for a shelf divider, label, and sign holder system. The support element includes a substantially U-shaped rigid plastic shell which may be adhesively affixed to the upper surface of a shelf to support a shelf divider. The support element includes elongated flexible ridges or beads within a support element channel, the free ends of which are spaced from and face the interior surface that defines the channel. The ridges are compressible to exert a gripping force on the item to be retained. The support element can also be part of a label and sign holder system. Both a single and double-facing support element is provided to interact with a label holder locking strip.

7 Claims, 9 Drawing Sheets

(REMOVE ADHESIVE ON DIVIDER RAIL(S))

UNIVERSAL SUPPORT ELEMENT FOR UNIVERSAL SHELF DIVIDER, LABEL AND SIGN HOLDER

This is a complete application claiming benefit of provisional application Ser. No. 60/554,345 filed Mar. 19, 2004.

BACKGROUND OF THE INVENTION

1. Field of the Invention

This invention relates to an integrated shelf divider, label and sign holder system and relates more particularly to an improved elongated universal support element, one or more of which may be adhesively affixed to a horizontal or vertical mounting surface, having elongated flexible semi-cylindrical ridges or beads located within a support element channel. The support element includes a cover portion and a mounting, or base, element. The ridges serve to removably retain the item to be supported or mounted within the support element channel. One such item is a shelf divider for merchandise shelving. Another such item is a label holder or combined label and sign holder.

A pair of such support elements can be affixed to the upper surface of a shelf, parallel the front and back longitudinally extending edges of the shelf, and in spaced relationship to each other. Opposed end mounting flanges of one or more elongated shelf dividers can then be slid between the flexible ridges of the support elements and the mounting, or base, element, to position upstanding divider elements generally perpendicularly to the front and back edges and the upper surface of the shelf.

In addition, the universal support element of this invention can be mounted generally horizontally, on a vertically extending surface to secure a sheet of material, which may be formed of paper, cardboard or plastic, to the surface for display of a message or sign to a passerby. Alternatively, a universal support element according to this invention can be secured to the undersurface of a generally horizontally extending shelf, adjacent the front edge thereof, to receive mounting portions of a label holder between the flexible ridges of the support element and the mounting element.

The universal support element of this invention can also be mounted on a horizontal shelf near the free edge thereof where the opening of the support element channel faces outwardly to receive a label holder and/or label and sign holder having a novel interlocking elongated locking strip arrangement. In yet another embodiment, a bidirectional dual support element is provided where back-to-back support elements have their channels facing in opposite directions to serve both as a holder for a label or sign holder, as well as a holder for a shelf divider.

2. Description of the Related Art

Shelf divider systems, such as those for retail store shelving, are well known in the art. One such shelf divider system is the subject of U.S. Pat. No. 5,836,097 entitled "Universal Shelf Divider, Label and Sign Holder System" which is assigned to the assignee of the present application. The '097 patent discloses a support element in combination with shelf dividers for mounting the shelf dividers to a shelf surface. The shelf dividers disclosed in the '097 patent are substantially identical to those used and described herein and, indeed, the shelf dividers of such '097 patent may be used with the improved support element of the present invention. The prior art '097 patent discloses a support element having an extended cover portion of substantially V-shape with a mounting, or base, element that is integral with the cover portion, but extends only part way along the overall width between the inner and outer edges of the cover portion. The cover portion includes a pair of flexible fingers that are greater in distance between the cover portion, from which they extend, to the base member. Thus, when the base member is secured to a mounting surface, the flexible fingers are compressed and directly engage the mounting surface in compression. There is no gap between the flexible fingers and the mounting surface.

As described in the '097 patent, when the item to be mounted or secured, such as the flange of a divider, is inserted into the support element, the item is captured between the flexible fingers and the mounting surface itself. The item to be supported can be inserted only part way into the support element. The item cannot be inserted all the way into the support element to the edge portion that connects the cover portion and mounting element. As a result, there are certain disadvantages with such a support element. In particular, the support element width must be relatively wide so as to accommodate the width of the base member and the adjacent width formed by the cover portion overlying the mounting surface. Further, the item to be inserted and captured can only be inserted approximately half way along the width of the support element. Thus, when a pair of support elements are mounted on front and back edges of a shelf, they take up a substantial portion of the shelf space. Still further, the divider member that is inserted and retained by the support elements cannot extend substantially the entire width of the shelf.

Similar disadvantages can be found when the '097 patent support element is used to support a label or sign. The overall width of the support element is wider than desirable and the label or sign to be inserted cannot be inserted substantially fully along the width of the support element.

Moreover, the support element disclosed in the '097 patent can be affixed to a shelf in a direction facing inwardly to support a shelf divider or outwardly to support a label holder or label/sign holder. A single shelf divider cannot perform both functions. Thus, if the support element is affixed to a shelf and oriented inwardly or toward the back of the shelf, it can be used only to support a shelf divider and not as a support for a label holder or label/sign holder.

SUMMARY OF THE INVENTION

It is therefor an object of the present invention to provide an improved support element, primarily for a universal shelf divider, to be mounted on the upper surface of a shelf in spaced opposed pairs extending generally parallel to each other and to the front and rear edges of the shelf, for reception of divider mounting flanges located at the opposite ends of upstanding shelf dividers.

A further object of this invention is the provision of an improved support element that is narrow in width, thus taking up little space on the mounting surface of the shelf, enabling the maximizing of the length of the shelf dividers from forward to rearward edges of the shelf.

A still further object of the present invention is to provide a generally U-shaped support element defining a channel for receiving the item to be supported, such as the mounting flange of a shelf divider, wherein the channel interior includes a plurality of substantially arcuate or semi-cylindrical ridges or beads that are elongated and extend substantially parallel to the connecting bridge of each of the legs of the U-shaped support element. The ridges are closely spaced apart from a facing interior surface of the support element and the ridges are compressed when an item to be supported is inserted.

Another object of this invention is the provision of a support element adapted for supporting a sheet of paper, cardboard or plastic sign or label, or a portion of a separate label holder, including a novel locking strip, wherein the item to be secured can be slid into the channel so as to be retained by the compressive force of the flexible ridges or beads.

A further object of the present invention is to provide a support element for mounting on the top of a shelf with the opening of the support element facing outwardly to receive a novel locking strip integral with a label holder or label/sign holder. The locking strip includes substantially rigid beads or ridges that interlock and are captured by the flexible ridges or beads within the interior of the support element.

Still further, it is an object of the present invention to provide a dual support element of generally two U-shapes in back-to-back relationship wherein one open channel faces in a direction 180° apart from the other open channel. The dual U-shaped support element may be affixed to a shelf at or adjacent the free edge thereof to support a shelf divider, as well as to support a label or label and sign holder.

A further object of this invention is to provide a shelf divider system utilizing the improved elongated support element in combination with thin plastic die-cut divider elements of the type described in the '097 patent.

Other and further objects, features, and advantages in the invention will become apparent from the ensuing description taken in conjunction with the attached drawings.

BRIEF DESCRIPTION OF THE DRAWINGS

Like reference characters refer to like parts throughout the several views of the drawings.

DESCRIPTION OF THE PREFERRED EMBODIMENTS

Figure 1:
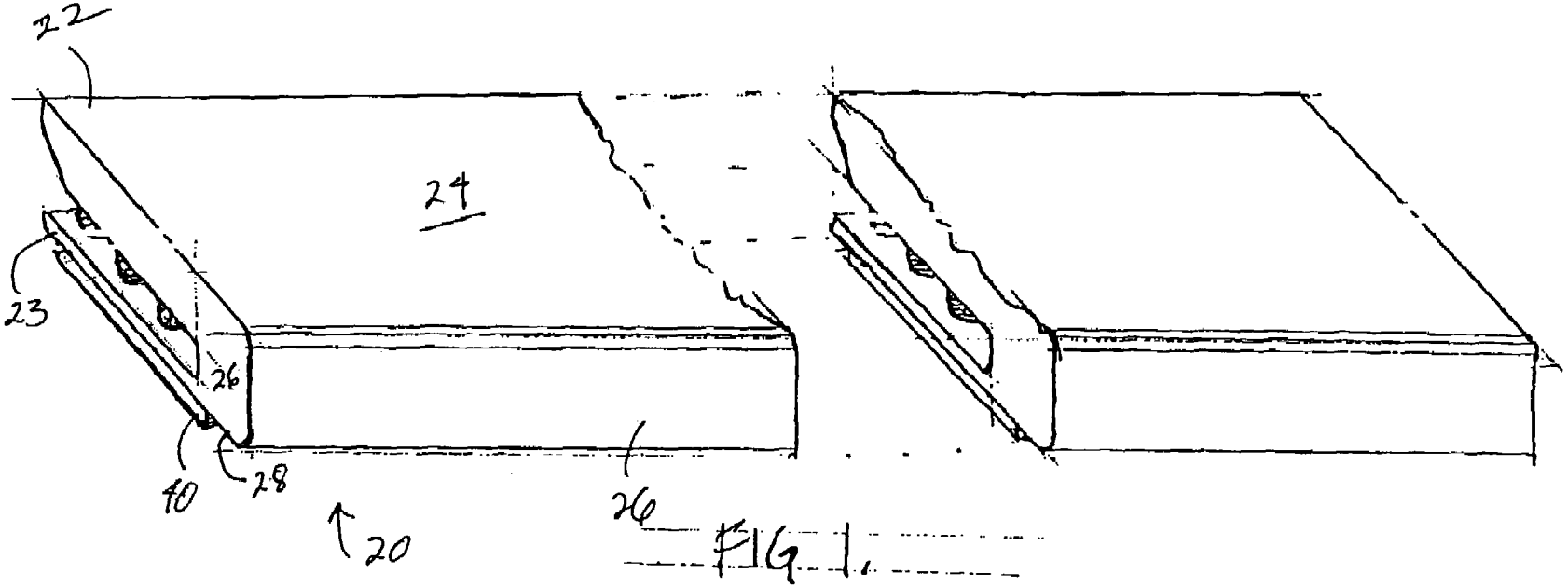
FIG. 1 is a fragmentary perspective view of an elongated universal support element adapted to display signage or label information parallel or perpendicularly to a horizontal or vertical mounting surface, and preferably adapted, when used singly or in opposed pairs, to act as a divider support element, or rail, to support upstanding shelf divider elements.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
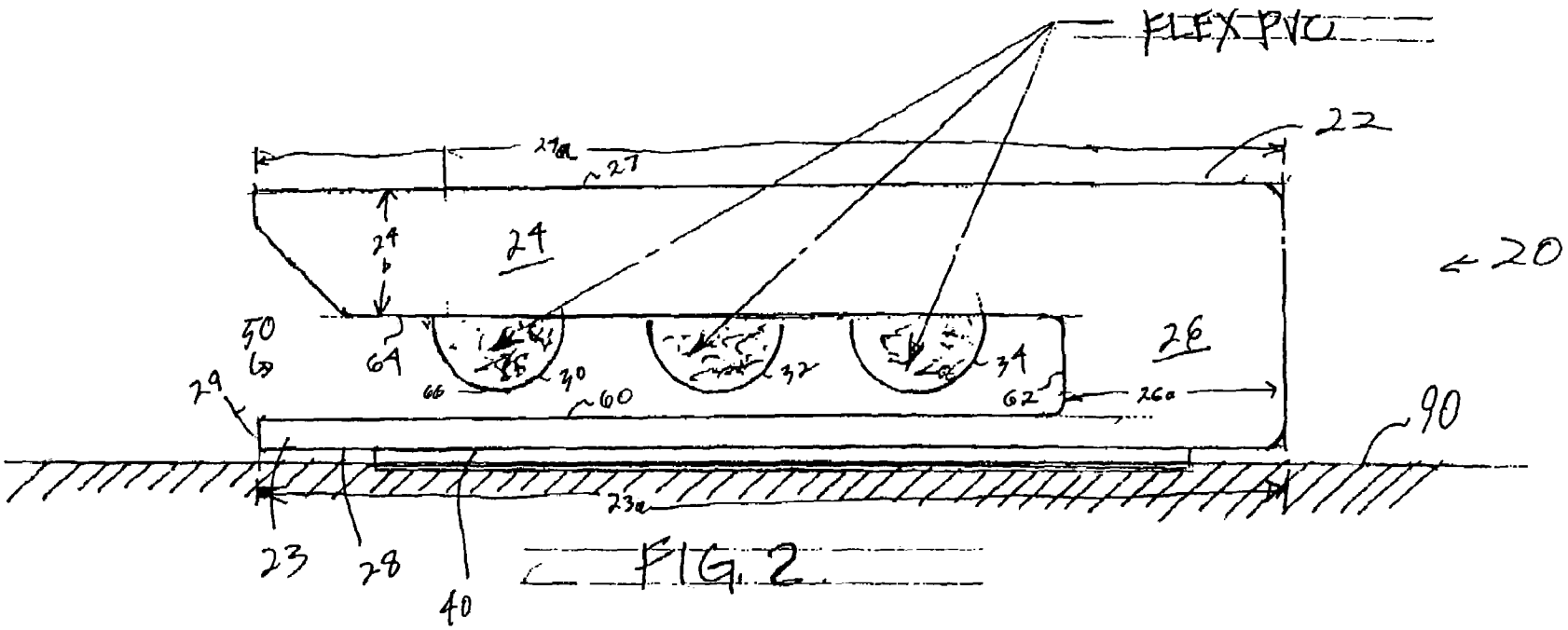
FIG. 2 is an enlarged end elevational view of the support element/divider rail of FIG. 1.

Referring now to the drawings, wherein like parts are identified by like characters, and more particularly to FIGS. 1 and 2, an elongated universal support element having particular, utility as a divider rail is designated generally by the reference numeral 20 and comprises a relatively hard plastic generally U-shaped shell 22 including a mounting or base portion or element 23 that forms one leg, and a cover portion or element 24 integrally connected along one longitudinal bridge edge 26. The hard plastic shell 22 is preferably a rigid PVC. The bridge edge 26, being formed of plastic, has a width 26*a* preferably about one-fifth the overall width 23*a* of the base 23 and is substantially perpendicular to the base 23 and the parallel cover portion 24. The bridge edge 26 is intended to be relatively stiff and does not typically perform as a hinge, thus maintaining the parallel relationship between the cover portion 24 and base 23 when an item is inserted into the channel defined by the base 23, bridge edge 26, and cover portion 24. The forces are absorbed by the flexible PVC ridges or beads 30, 32, 34 in a manner to be described. However, under certain circumstances, where the item to be inserted is relatively thick and the reactive forces on the ridges results in a full compression of the ridges, then a slight hinging of the cover portion 24 about the bridge edge 26 may occur. Similarly, the cover portion 24 itself may bend slightly when such large "opening" forces take place.

Figure 4:
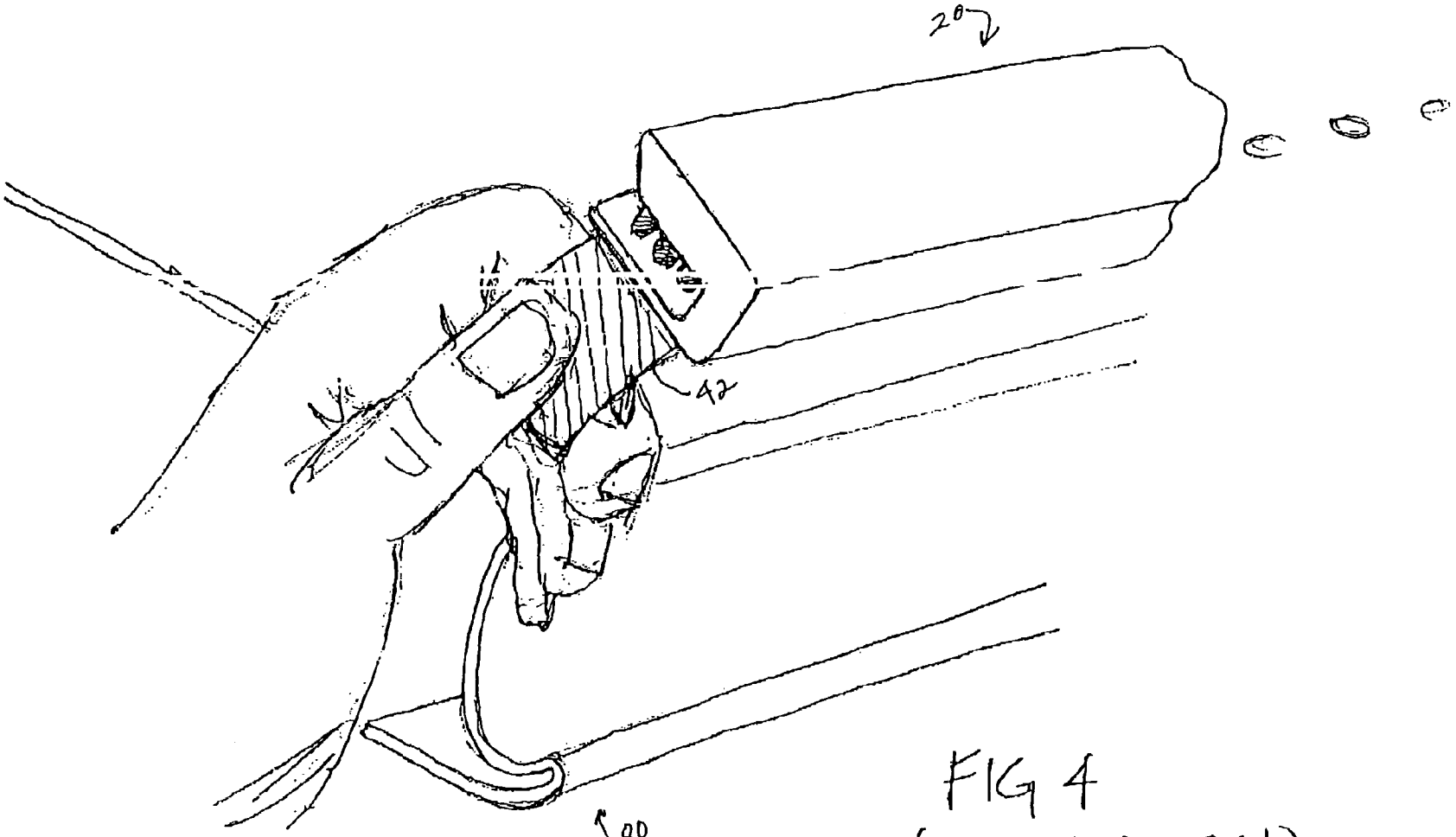
FIG. 4 depicts the removal of a release cover strip for an adhesive tape to enable the support element to be affixed to an edge of a shelf.

The base member 23 has a generally planar outer surface 28 that carries a strip of pressure-sensitive adhesive tape or the like 40 which may be covered with a release paper strip 42 as shown in FIG. 4. The release paper 42 is removed just prior to application of the support member to the surface upon which it is to be mounted. As shown in FIG. 4, the support member 20 is to be mounted at the front edge of a shelf that includes a flat or C-shaped channel member 80, 152 at the front of the shelf 150 for display of labels, signage, etc. The base or mounting member 23 has a free edge 29 which is shown substantially square. It should be understood that the free edge 29 could be beveled or rounded to assist insertion of the item to be supported.

Preferably, the adhesive tape width is one-half inch and extends a substantial distance along the length of the bottom outer surface 28 and along almost the entire width of the bottom outer surface 28. The tape is very thin, preferably 0.005 inches (5 mils), thus enabling a relatively flush mount with the mounting surface 90.

The cover portion 24 of the support element 20 lies substantially parallel to the base member 23 and its width 24*a* is substantially equal to the width 23*a* of the base member. Thus, the open end or mouth 50 of the support member 20 is defined by a pair of U-shaped legs 23, 24 that terminate along a line perpendicular to each of the legs 23, 24. The cover portion 24 is substantially thicker 24*b* than the thickness of the base member 23. Preferably, the thickness 24*b* is one-half the overall thickness between the planar outer surface 28 and the planar upper surface 27. In addition, the free end of the cover member 24 is beveled, as shown in FIG. 2, to facilitate the insertion of the item to be mounted. That is, if the item to be mounted is inserted from the top and angled downwardly at approximately 45°, the beveled surface serves as a guide to assist in deflecting the item to ultimately be parallel with the base member 23.

Coextruded in a well known manner with the hard plastic shell of the mounting element 20 is preferably three elongated semi-cylindrical ridges or beads 30, 32, 34 of flexible PVC material, such as 75 durometer PVC. The elongated ridges are intended to extend the full length of the support member 20, although, under certain circumstances, they may terminate short of the opposite free ends of the support element. Although three ridges 30, 32, 34 are depicted, it should be appreciated that a lesser or greater number could be utilized. Further, although the ridges 30, 32, 34 are shown as substantially one-half of a cylinder in the cross-section of FIG. 2, the arcuate configuration of the outer surface of each of the ridges may be altered and need not be exact. That is, the ridges could be less than a full semi-cylinder, but may be defined by a chord that extends less than the cylinder diameter. Alternatively, the ridges could extend beyond the diameter of the imaginary cylinder and, thus, the perimeter of the ridges could be turned somewhat inward where they engage the inner surface 64 of the cover portion 24. The important factor is that the ridges or beads be flexible and compressive and form a gap or space with the upper surface 60 of the base member 23.

The interior surfaces of the base member 23, bridge edge 26 and cover portion 24, are shown as numerals 60, 62, 64, respectively, to define an insertion channel whose opening or free end 50 receives the item to be secured. A gap or space is provided between the extreme end of the ridge, shown as numeral 66 on ridge 30, and the surface 60 of the base member 23. This same gap is provided for each of the ridges 32 and 34. The overall height between surface 60 of the base member 23 and surface 64 of the cover portion is preferably 0.050 inches and the gap between point 66 and surface 60 is preferably 0.010 inches. Thus, when items to be retained have a thickness greater than the gap thickness, which is intended, the flexible PVC ridges will compress and a compressive force between the ridges and the upper surface 60 of the base member will frictionally retain the item to be secured within the channel.

Figure 3:
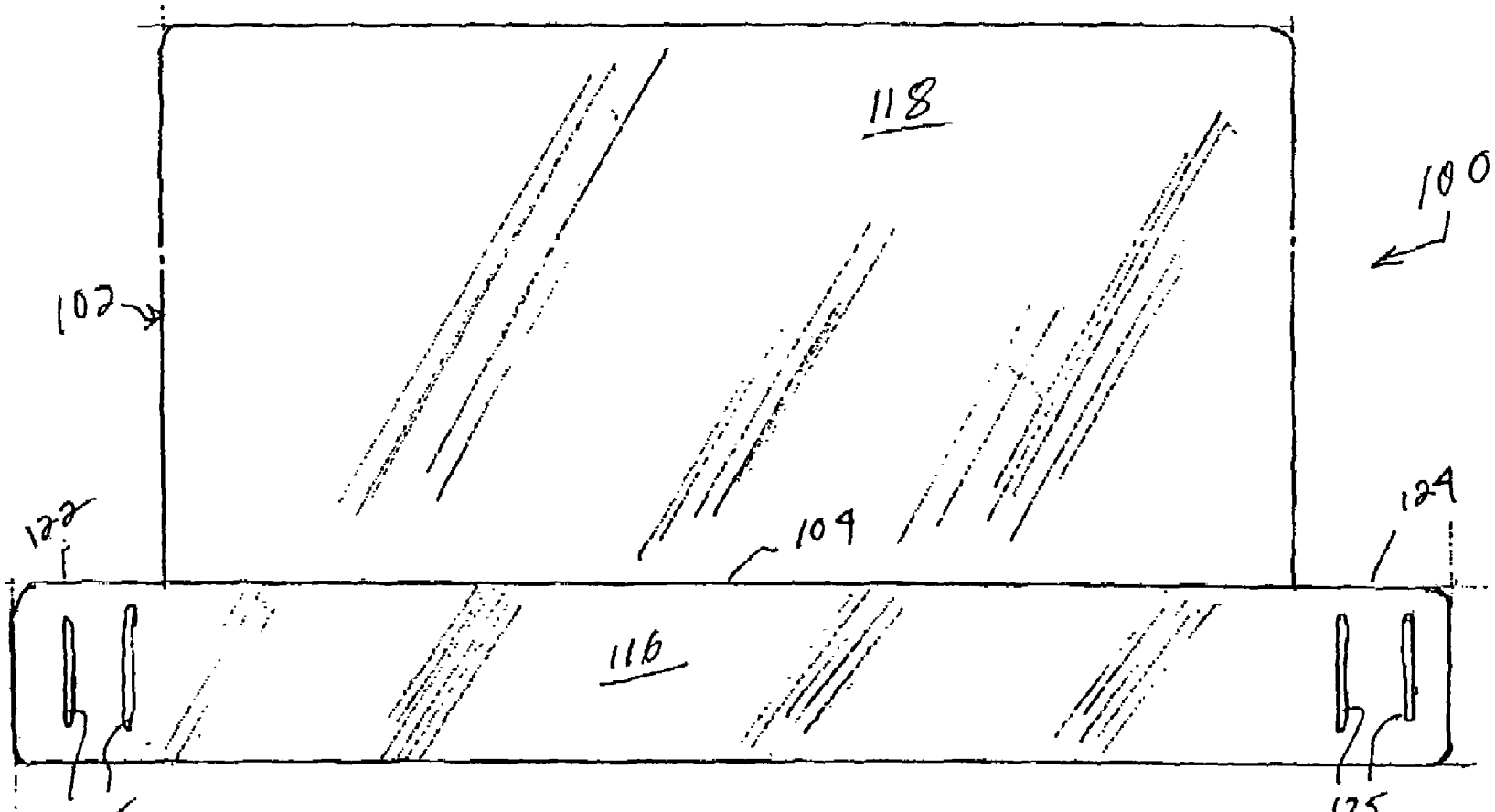
FIG. 3 is an elevational view of a blank which can be folded to form a shelf divider member which may be secured to the upper surface of a shelf by a pair of universal support elements according to the instant inventive concepts.
Figure 5:
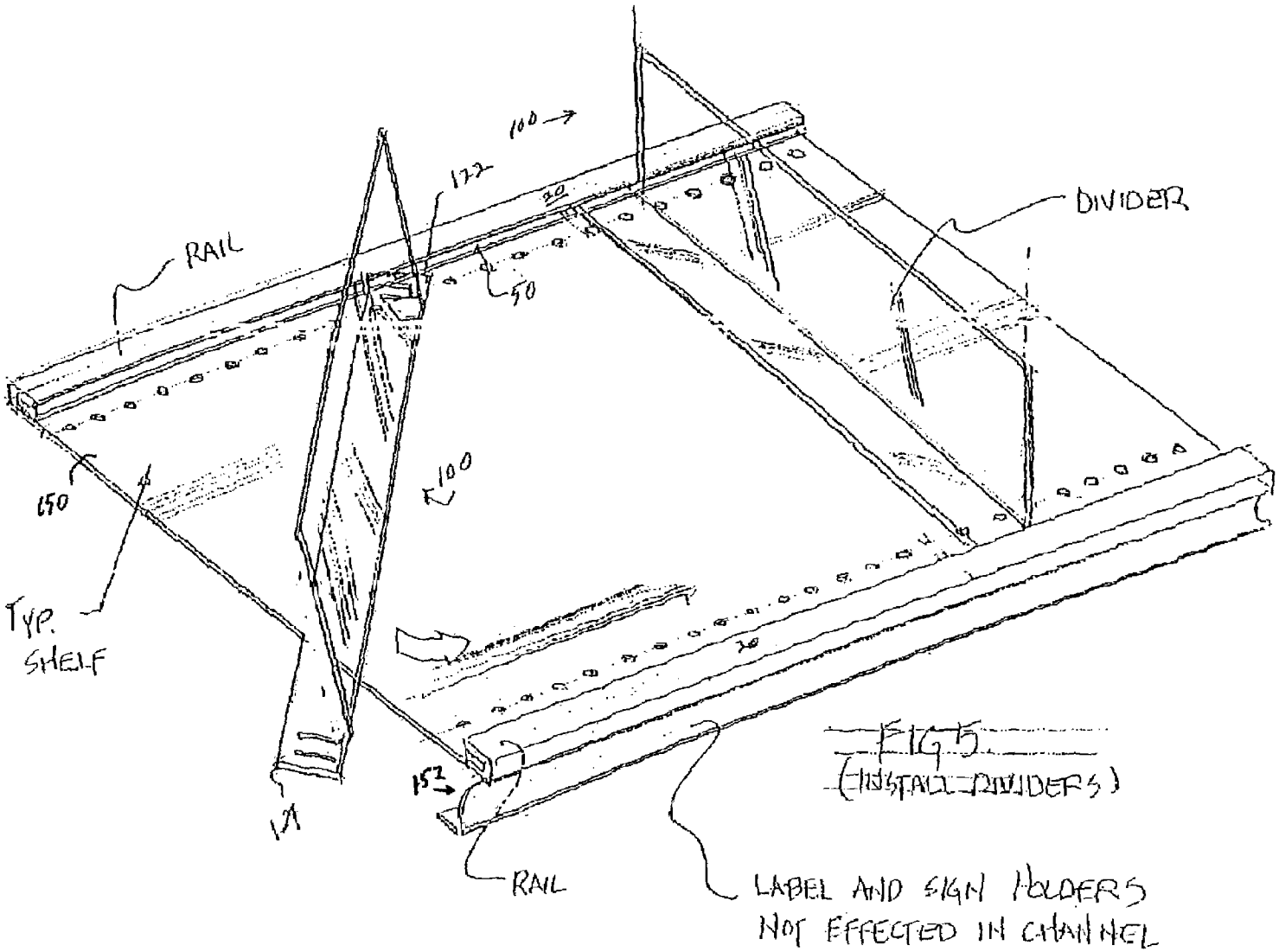
FIG. 5 is a perspective view showing one shelf divider member secured in position on the upper surface of a shelf, and a second shelf divider member being engaged in the mounting or support elements.

Referring now to FIGS. 3-5, the support member 20 acts as a shelf divider rail to support flange portions 122, 124 of a divider 100. In FIG. 3, a divider blank 102 is shown and is preferably formed from thin plastic sheet material, such as rigid PVC. During extrusion and formation, a heat fold regular crease is formed at 104 between the divider member 118 and divider support member 116. The divider member 118 and support member 116 are folded substantially perpendicular to each other about the heat fold regular crease 104. The finished divider 100 is best shown in FIG. 5 and it is seen that the divider member 118 is slightly offset from perpendicular with respect to the divider support member 116. The support member 116 of the divider is longer than the divider member 118 so that the opposed end portions define mounting flanges 122, 124 which are insertable in the support member 20. Each of the end portions define matrix creases 125 which creates a raised line or edge in the plastic during formation which provides added thickness for tighter retention within the channel of the support member. The use of the shelf divider system is shown in FIG. 5 where a pair of divider rails or support elements 20 are affixed in spaced relationship to the upper surface of the shelf and extend generally parallel to each other and parallel to the front and rear edges of the shelf. The channel openings face each other. The opposed end portions or mounting flanges 122, 124 of each shelf divider are slidingly engaged through the mouth 50 of the support member and into engagement with, and gripped between, the ridges 30, 32, 34 and the upper surface 60 of the base member 23. Preferably, the flange thickness on the shelf divider is 0.020 inches (20 mils) or approximately twice the thickness or space between the end 66 of the ridges and the surface 60 of the base member 23. Thus, the flexible PVC ridges will deform or compress rather substantially to provide the gripping force on the flange ends. In the example provided, the distance between the free end 66 of the ridge 30 and the surface 64 of the cover portion 24 is 0.040 inches. Thus, in the example provided, the ridges will distort approximately ¼ of their undistorted free height.

It should be appreciated that the shelf divider 100 is substantially identical to the shelf divider as shown in the '097 patent, incorporated herein by reference.

It should also be appreciated that the universal support element 20 of the present invention can be utilized as a support for a sign or flexible sheet of material, such as paper, or used to support a label holder. With reference to the '097 patent, FIG. 3 thereof depicts a support element that can be secured to a generally vertically extending surface with the channel member opening downwardly for receipt of a sign. The support member of the present invention can be used as a sign holder in the same manner as disclosed in the '097 patent and such is incorporated herein by reference.

Figure 7:
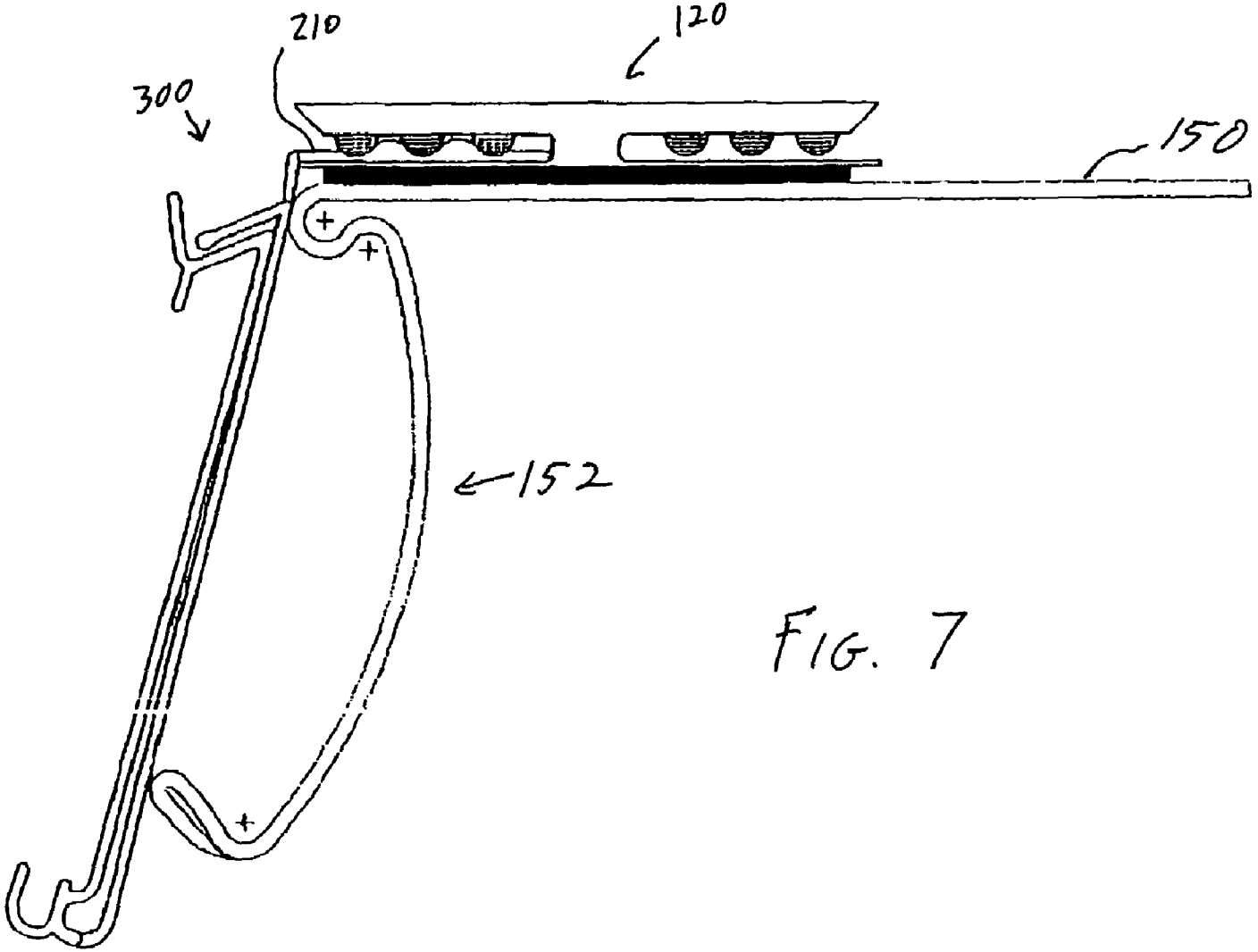
FIG. 7 is a side or end view of the double-sided or dual support element mounted adjacent the edge of a shelf with a C-channel and depicts a combined label and sign holder secured thereto.

Similarly, FIG. 7 of the '097 patent discloses the channel member being mounted to the underside of a shelf adjacent the front edge thereof with the mouth of the channel facing outwardly or toward the aisle. The channel can receive a bracket of a label holder. It should be appreciated that the support element of the present invention can be utilized in the same manner and the '097 patent is incorporated by reference herein to show such usage.

It should further be understood that the surface 62 which is the interior surface of the bridge edge 26 acts as a stop member for limiting the inward movement of the item to be secured. Because this stop member 62 is at a distance 26*a* from the edge of the support member, it can be seen that the item to be secured can be inserted to extend almost to the edge of the surface upon which the support member is mounted. Thus, with reference to FIG. 5, the flange members 122, 124 of the divider can extend substantially the full width of the support member 20, and the divider portion 118 can extend just less the entire distance between the shelf edges.

FIGS. 6-9 depict a second embodiment of a support element called a bidirectional or dual support element 120. Dual support element 120 includes back-to-back integrally connected support elements of the same configuration as described above with regard to the embodiments of FIGS. 1-5, wherein the mouth of the channel faces in opposite directions. The dual support element includes mounting or base portions 123A and 123B, and cover portions 124A and 124B, each of which are of the same size and shape as base portion 23 and cover portion 24 of the FIGS. 1-5 embodiment. Bridge portion 126 is of the same dimension as the bridge 26 of the embodiment of FIGS. 1-5. The dual support element 120 also includes flexible PVC ridges or beads 130A, 132A, 134A in the channel that faces in one direction, and ridges or beads 130B, 132B, 134B in the opposite facing channel. These are of identical size and shape as the flexible ridges or beads 30, 32, 34 of FIGS. 1-5. Pressure sensitive adhesive tape or the like 140 is shown and is of the same dimensions as tape 40 in the embodiment of FIGS. 1-5. Indeed, the overall structure of dual embodiment of FIGS. 6-9 is identical to that of FIGS. 1-5, with the exception that only a single bridge 126 is common to both U-shaped support elements.

Figure 6:
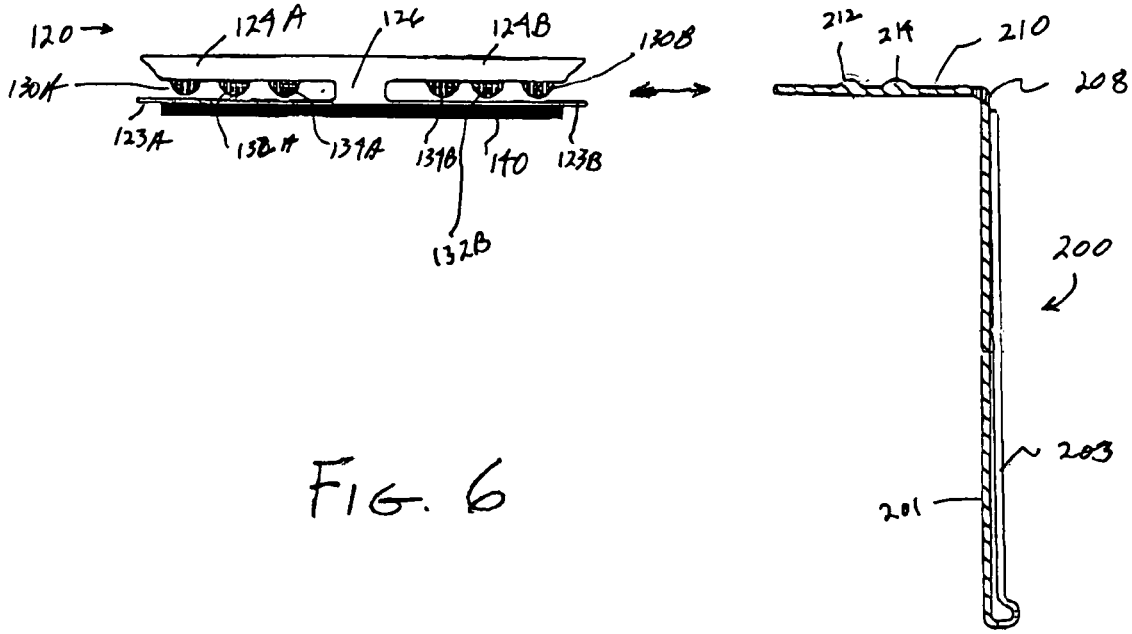
FIG. 6 is a side or end view of a double-sided or dual support element wherein opposite facing channels are arranged in back-to-back relationship, one channel of which is arranged to receive a label holder having a locking strip integrally formed therewith.

The dual support element 120 of FIG. 6 may be mounted at the edge of a shelf 150, 250 with one channel of the dual U-shaped member facing outwardly to receive a label holder 200 or label/sign holder 300, while the other channel faces rearwardly to support a shelf divider of the type described above. A single U-shaped support element will be secured to the shelf at the back thereof to receive the other side of the shelf divider as described above.

Figure 9:
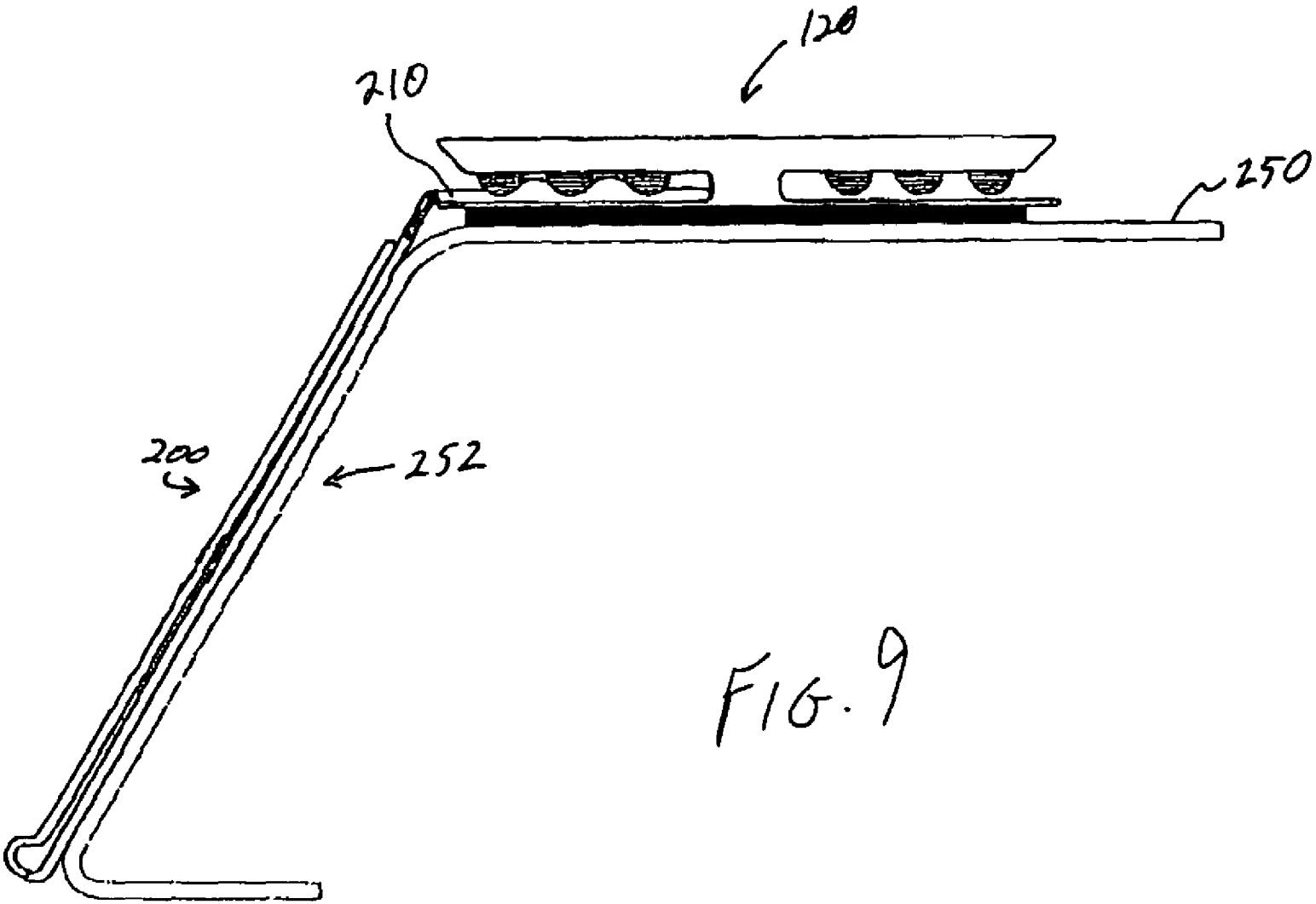
FIG. 9 is a side or end view of the double-sided or dual support element with a label holder secured thereto mounted to a shelf having a linear or flat front edge.

The dual support element 120 is intended to receive a label holder of the type shown as numeral 200. Such label holders include a display portion well-known in the art and includes a back portion 201 hinged to a clear window 203. The back portion is integral with a novel locking strip 210 through a flexible hinge 208. The locking strip 210 is of substantially rigid PVC and includes two elongated ridges 212, 214. The orientation of the ridges 212, 214 is such that they coact with the three flexible PVC ridges 130B, 132B, 134B within the channel to be gripped tightly therein. See, for example, FIG. 9 which shows the label holder 200 connected to the dual support element 120 and retained therewithin. As shown in FIG. 9, the double-sided support element is mounted to a shelf 250 having a flat or linear front edge 252. The thickness of the locking strip 210 is greater than the distance between the free edge of the flexible ridge within the channel member and the interior surface of the base member so as to provide a compressive force between the flexible ridge and the top of the locking strip 210.

Figure 8:
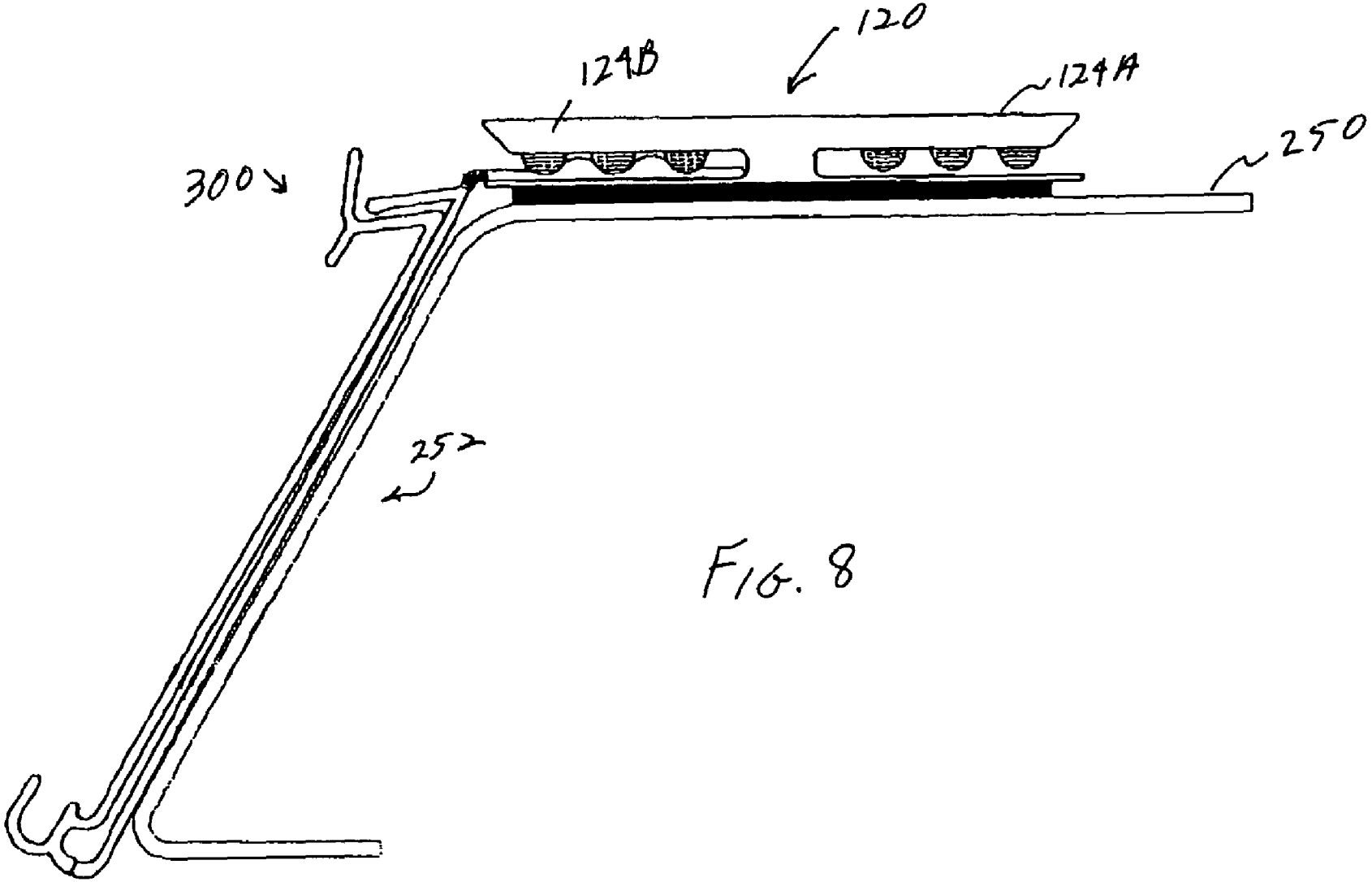
FIG. 8 shows the double-sided or dual support element with a label and sign holder affixed thereto mounted to a shelf with a linear or flat front face.

FIG. 7 shows the dual support element 120 utilized with a locking strip 210 that is integrally formed with a combined label and sign holder 300. In this example, the dual support element 120 with attached label and sign holder 300 is mounted to the free or front edge of a shelf 150 having a C-channel 152 at the front face. FIG. 8 depicts the same embodiment, but mounted to a shelf 250 where the front face of the shelf 252 is flat or planar.

It should be understood that the single U-shaped support element 20 of the type shown in FIGS. 1-5 can be mounted to the free edge of the shelves as shown in FIGS. 7-9, and will be adapted to receive the locking strip 210 of the label holder 200 and label and sign holder 300. It should also be understood that different label holders or label and sign holders could be utilized, including those of the electronic shelf label holder type. The specific form of the label holder itself is not the novel portion of the present invention but, rather, only the novel locking strip portion 210.

As is seen in FIGS. 7, 8 and 9, the locking strip, when inserted into the channel of the support element, extends to the back or interior wall of the bridge element 126.

Both the single and dual support elements 20, 120 can be of substantial length, such as four feet in length to extend the full length of the shelf. Similarly, the locking strip 120 of the various label holders can also extend the entire length of the shelf and can be removed easily from the shelf if, for example, the shelf has to be washed. This removes the labels and avoids the problem of the labels getting wet. Then, the entire locking strip can be replaced and reinserted into position.

The term "label holder" as used in the following claims is intended generically to cover a label holder and combined label/sign holder of any and all configurations.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. An elongated universal support element comprising an elongated, substantially rigid, generally U-shaped member including, a mounting portion and a cover portion each of which has an inner surface and an outer surface and first and second longitudinally extending edges, said cover portion substantially parallel to said mounting portion and spaced therefrom, and a bridge portion integral with and interconnecting said mounting portion and cover portion at the said first edges of the mounting portion and cover portion, the mounting portion and cover portion substantially equal in width from their first edges to said second edges, and wherein the cover portion thickness is substantially greater than the mounting portion thickness, a plurality of elongated parallel ridges integral with the inner surface of one of said mounting portion and cover portion within the interior of said U-shaped member, each of said ridges relatively flexible in comparison to said mounting portion, cover portion, and bridge portion, wherein said mounting portion, said cover portion, and said bridge portion are formed from rigid PVC and said ridges are integrally extruded flexible PVC, and substantially arcuate in cross-section and extend longitudinally along the length of the U-shaped member, the ridges defining a gap between an outermost extremity of a ridge and the inner surface of the other of said mounting portion and cover portion, wherein said ridges will flexibly compress to enable an item having a thickness dimension greater than the said gap to be inserted into the U-shaped member to be retained between said ridges and said inner surface of the other of said mounting portion and cover portion with said mounting portion and said cover portion remaining parallel and not flexing upon insertion of said item, such that all forces are absorbed by said ridges, said mounting portion being adapted to be affixed to a mounting surface, and wherein said item to be inserted includes a substantially planar locking strip of rigid material relative to the said parallel ridges integral with the inner surface of one of said mounting portion and cover portion within the interior of said U-shaped member, said item to be inserted further including a pair of relatively rigid locking strip ridges disposed so as to be complementary to said flexible ridges.

2. The support element of claim 1, wherein the width of said bridge portion from said first edges to the interior of said U-shaped member is approximately one-fifth the width of said mounting and cover portions.

3. The support element of claim 1, wherein said second edges of said cover portion and mounting portion are free edges and said free edge of said cover portion is beveled.

4. The support element of claim 3, wherein said outer surface of said mounting portion includes adhesive for affixing said U-shaped member to a mounting surface.

5. The support element of claim 1, wherein the item to be inserted is a shelf divider.

6. The support element of claim 1, wherein the item to be inserted is a label holder.

7. The support element of claim 1, further comprising a second substantially rigid, generally U-shaped member of identical configuration to said generally U-shaped member and sharing a common bridge portion, wherein the two U-shaped members are disposed in opposite directions.

* * * * *